United States Patent [19]

Jones et al.

[11] 4,208,819

[45] Jun. 24, 1980

[54] BOTTLE-ENGAGING INFORMATION PIECE

[75] Inventors: John H. Jones, Westfield; Patrick Hipko, Milltown, both of N.J.

[73] Assignee: Beatrice Foods Co., Chicago, Ill.

[21] Appl. No.: 909,773

[22] Filed: May 26, 1978

[51] Int. Cl.[2] ..... G09F 3/00

[52] U.S. Cl. ..... 40/310; 40/21 B

[58] Field of Search ..... 40/21 B, 21 R, 310

[56] References Cited

U.S. PATENT DOCUMENTS

| | | | |
|---|---|---|---|
| 1,853,622 | 4/1932 | Kennedy | 40/310 |
| 1,984,559 | 12/1934 | Wilcox | 40/21 B |
| 2,132,236 | 10/1938 | Greene | 40/21 B |
| 2,135,830 | 11/1938 | Neher | 40/21 B |
| 3,149,431 | 9/1964 | Blish | 40/310 |

FOREIGN PATENT DOCUMENTS

| | | | |
|---|---|---|---|
| 995613 | 12/1951 | France | 40/21 B |

*Primary Examiner*—John W. Shepperd

*Attorney, Agent, or Firm*—Shlesinger, Arkwright, Garvey and Dinsmore

[57] ABSTRACT

A device for attaching display material to a bottle and a process for making the device are disclosed. The device includes a booklet and a flexible bottle-engaging means connecting the booklet to a bottle. The flexible bottle-engaging means is attached to the bottle and the booklet so as to urge the booklet against the bottle. The device can be made by a continuous process that involves feeding an information carrying web and a flexible web, gluing the webs together, forming a booklet out of the information carrying web, and then severing the web to form individual devices.

6 Claims, 8 Drawing Figures

BOTTLE-ENGAGING INFORMATION PIECE

BACKGROUND AND FIELD OF INVENTION

This invention relates to a means for attaching information carrying material to bottles, jars, and other consumer goods.

The value of attaching information to a consumer product in a way that the material can be examined by a prospective consumer has long been recognized. Efficiency of the advertising copy is greatest if the consumer is exposed to the material shortly before the sale. Today the labels on consumer goods are a widely used advertising medium.

Similarly it is often desired to include with the product information that the consumer will need after the product is purchased. Instructions, usggestions, warnings and warranties are commonly included with the product. It is desirable to maintain these messages in close proximity to the consumer goods. In the past information carrying material has been attached to bottles by a cord or collar that encircles the bottle. These techniques do not securely present the advertising material to the consumer in a manner that will make the material conspicuous and easy to read. Cords and collars often do not remain secured to the bottle and the advertising material is lost in transit.

Often a seller would like to convey more information than can be carried on a card or a label. Booklets or pamphlets are the next step. However in the past booklets and pamphlets have not been widely used because they tend to be bulky, and expensive to produce and attach to the consumer goods. The pamphlet, which usually lies loose on the bottle, tends to open like an accordian obscuring what is often the more essential information contained on the bottle label. Bulkiness of the pamphlet often leads to its removal from the bottle either during or after transportation.

FEATURES AND SUMMARY

An important feature of this bottle display means is that it is capable of being continuously produced.

Another feature is that the device is maintained firmly against a consumer product so that the device will be less bulky and less liable to be accidentally torn from the bottle or consumer good.

Another feature is that means are provided to maintain the advertising material in a desired position on the bottle.

Another feature of this invention is means for locking the display device to the bottle.

Another feature is a means for facilitating removal of the device from the bottle.

Still another feature of this invention is a process whereby the means for securing the device to the bottle can be continuously attached while advertising material is being folded and glued.

Another feature of this invention is a process for making such a device continuously from rolls of web material.

These and other features of this invention are accomplished by a device for displaying material on a bottle or the like and a process for making the device. The means for displaying material includes the display material itself and a flexible bottle-engaging sheet attached to the display material. A slot in the sheet securs the device to the bottle by engaging the bottle neck. The sheet is attached to the booklet so that when the slot engages the bottle neck, the display material is pressed against the side of the bottle by the spring action of the flexible sheet. The bottle engaging sheet also includes a locking tab for securing the device to the bottle and a tab for facilitating gripping and removing the device.

The device is made by a continuous process. Two webs are continuously fed, one being an information carrier and the other being a flexible web. A slot is punched in the flexible web and the web is then attached to the information carrying web. Next the information carrying web is folded and the two webs are cut into booklet form.

DETAILED DESCRIPTION OF INVENTION

Figure 1:
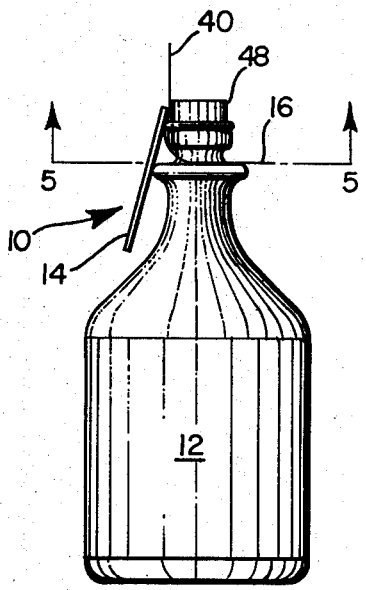
FIG. 1 is a perspective view of the invention attached to a bottle.

An information carrying display device 10 is shown in FIG. 1 attached to a bottle 12. The device includes an information carrying booklet 14 and a flexible bottle-engaging portion 16.

Figure 2:
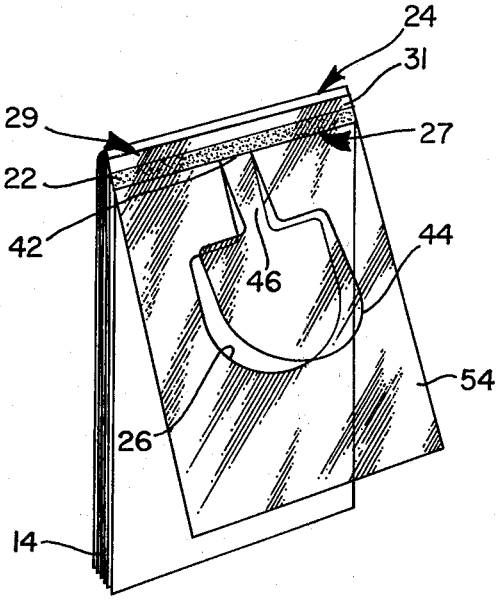
FIG. 2 is a perspective view of the invention shown in FIG. 1.
Figure 3:
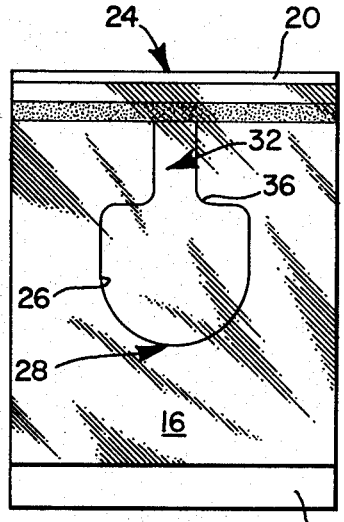
FIG. 3 is a back view of the invention shown in FIG. 2.
Figure 4:
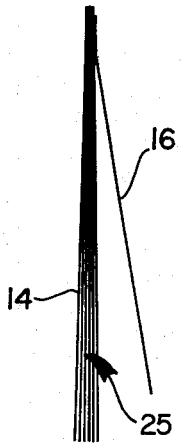
FIG. 4 is a side view of the invention shown in FIG. 3.

Flexible bottle-engaging portion 16 is also shown in FIGS. 2 and 3. Portion 16 is preferably made of a clear plastic such as mylar. As shown in FIG. 3, portion 16 has a width equal to that of the booklet 14 but its length is slightly less than that of the booklet leaving lower section 18 and upper section 20 uncovered by the portion 16.

The portion 16 is attached to the booklet 14 by attachment means 22, preferably being a glue strip, having length L and width W. FIGS. 2 and 3 show the portion 16 positioned slightly below the top edge 24 of the device 10 leaving uncovered upper section 20 of booklet 14. The lower edge 27 of the attachment means 22 must be spaced from the top edge 29 of the portion 16 so that the section of the portion 16 above the lower edge 27 urges the rest of the portion 16 against the rear face 25 of the booklet 14 when the portion 16 is flexed away from the booklet 14. As shown in FIG. 2 the lower edge 27 is about ¼ inch from the top edge 29. An unglued region 31 is left above the attachment means 22. The region 31 may aid in resisting the pivotal motion of the part of the portion 16 below the lower edge 27 of the attachment means 22.

A bottle-engaging opening 26 enables the device 10 to engage the neck of a bottle 12 as shown in FIG. 1. The opening can have any shape including an O-shape so that it totally encircles the bottle neck or a C-shape, engaging only part of the circumference of the bottle neck.

As shown in FIG. 3 the opening 26 includes a lower semi-circular section 28, an upper rectangular portion 30 and a narrow rectangular slot 32 which radiates from the top center edge of rectangular portion 30. The radiating rectangular slot 32 extends from the rectangular portion 30 to the lower edge 27 of attachment means 22.

Figure 5:
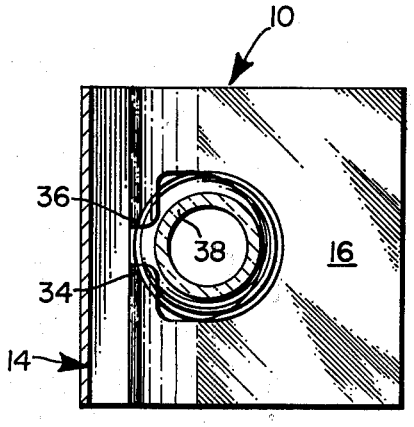
FIG. 5 is a cross-sectional view taken along the lines 5—5 in FIG. 1.

Bottle neck locking tabs 34 and 36 are created by the intersection of the rectangular portion 30 and the radiating slot 32. These tabs 34 and 36 serve to lock the device 10 to the bottle neck 38 as shown in FIG. 5. When bottle 12 is pushed through the portion 16 the tabs 34 and 36 will be deformed in the direction of passage. Since the portion 16 is made of resilient material this deformation will cause the tabs 34 and 36 to press against the bottle neck 38 thereby holding the device 10 in position.

A gripping flange 40 is shown in FIGS. 1 and 2. The flange 40 may be formed from the portion punched out to form an opening 26. As shown in FIG. 2 the portion 40 is attached to the device 10 at edge 42. If the flange is made by punching out a section to form the opening 26, the edge 42 can be left intact thereby creating a flange 40 already attached to the device.

The flange 40 includes a finger gripping portion 44 and a narrow connecting portion 46. The flange 40 is preferably made of a clear, resilient plastic such as mylar.

When a bottle 12 is passed through the opening 26, flange 40 is deformed in the direction of passage of the bottle 12. The narrow connecting portion 46 then presses against the bottle cap 48 because of its internal resiliency and the gripping portion 44 is directed vertically above the cap 48. Thus when it is desired to remove the device 10, the gripping portion 44 can be gripped between the thumb and forefinger and pulled upwardly.

In operation the bottle-engaging portion 16 secures the device 10 to the bottle 12 and urges the rear face 25 of the information carrying booklet 14 against the side of the bottle 12. This result is due to the resiliency of the portion 16 and to the method of connection of the portion 16 to the booklet 14 and bottle 12. More precisely the portion 16 is secured in face-to-face relationship with the back face 25 of the booklet 14. This is preferably accomplished as described above, by an attachment means 22 which is a glue strip. The lower edge 27 of the attachment means 22 is positioned sufficiently below the top edge 29 of the portion 16 to insure the flexible portion 16 is oriented parallel to the booklet 14, and resists pivotal deflection of the lower part of the portion 16 away from the rear face 25 of booklet 14. Thus in use, the portion 16 must be flexed away from the booklet 14 to engage the bottle neck 38. Portion 16 then pulls the booklet 14 against the side of the bottle 12.

Figure 6:
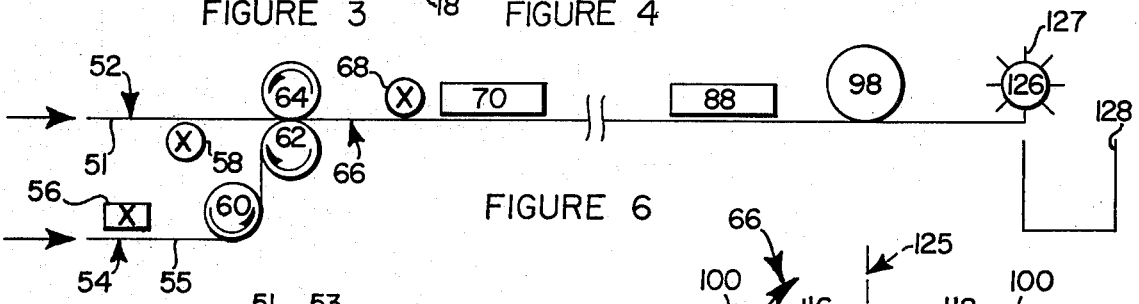
FIG. 6 is a schematic showing the process for making the device.
Figure 7:
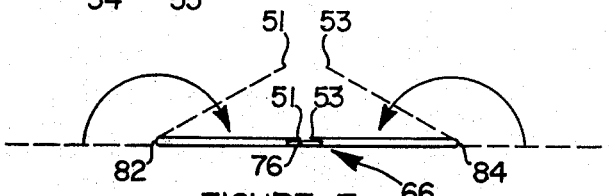
FIG. 7 is a cross-sectional view taken along the lines 7—7 in FIG. 6.
Figure 8:
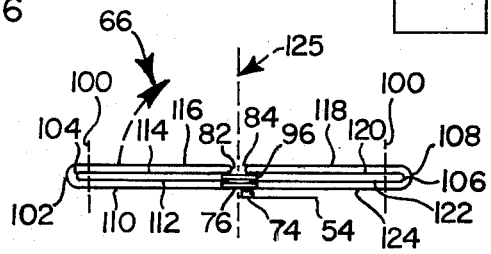
FIG. 8 is a cross-sectional view taken along the lines 8—8 of FIG. 6.

The process for making the device is illustrated in FIGS. 6, 7 and 8. As shown in FIG. 6 two webs 52 and 54 are continuously fed for production of the device. Web 52 is preferably continuously fed from a preprinted paper roll. The web 54 is preferably fed from a roll of flexible material. The web 52 may be much wider than the web 54 since the edges of the web 54 may be folded inwardly to form pages in the booklet 14, as described later. The width of the web 52 is defined by lateral edges 51 and 53 (only edge 51 is shown in FIG. 6) and its length is defined by longitudinal ends not shown. Similarly the width of the web 54 is defined by lateral edges 55 and 57 (only edge 55 is shown in FIG. 6) and its length is defined by longitudinal ends not shown.

The web 54 is punched at station 56 forming what eventually will be the opening 26 in flexible portion 16 of the completed device 10. The punching apparatus may be any conventional die punch.

While the web 54 is being punched, the web 52 passes through a gluing station 58. Preferably, a longitudinal glue strip is applied to the web 52 by a conventional means such as a roller. The web 54 is brought into contact with the web 52 by redirecting means designated 60, 62 and 64 which preferably are rollers. The glue strip constituting the attachment means is indicated at 22 in the completed device 10 as shown in FIG. 2. In the preferred form of the invention a glue strip is applied to one side of the lateral midpoint of the web 52 and the upper lateral edge 57 of the web 54 is oriented under the glue strip.

The combined webs 66 are then fed to a gluing station 68 where glue is applied to the upper surface of the web 66 in a strip in the direction of movement of the web 66 preferably approximately at the lateral midpoint of the web 66. At folding station 70, usually an edge folder, lateral edges 51 and 53 of the web 52 are then folded toward each other, and the glue strip applied at station 68. Any conventional folding machine may be used, but the one described in U.S. Pat. No. 3,743,273 to Katz et al is preferred. The disclosure of the patent is hereby incorporated by reference herein.

FIG. 7 illustrates the folding operation that occurs at folding station 70. The means of attachment between the flexible web 52 and the information carrying web 54 is indicated at 74. The glue strip applied at station 68 is shown at 76 approximately at the lateral midpoint between the edges 51 and 53 of the web 52. As shown by arrows in FIG. 7 the lateral portions 78 and 80 of the web 52 shown in broken lines are folded toward each other and towards the lateral midpoint of the web 52 so that the lateral edges 51 and 53 abut atop glue strip 76 causing edges 51 and 53 to be glued to the lateral midpoint of the web 52. New lateral edges 82 and 84 are then formed on the web 66.

The gluing and folding step may be repeated any number of times to form a booklet 10 of a desired number of pages. Each additional folding and gluing operation increases the number of pages in the device 10.

The web 66 is next fed to a folding station 88. At the station 88 one lateral half of the web 66 is folded over on top of the other half bringing together the lateral edges 82 and 84 of the web 66. Preferably the half of the web 90 not adjacent to the flexible web 54 is folded on top of the portion 92 which is adjacent to the flexible web 54.

FIG. 8 shows a web 66 in which the inward folding and gluing step first undertaken at stations 68 and 70 was repeated once at stations not shown. A device results in which the booklet portion 94 is of a width close to that of the flexible web 54. The device is glued at 74 at station 58, at 76 at station 68 and at 96 by stations not shown.

The web is next slit at station 98 along the line 100 shown in FIG. 8. This causes the folded ends 102, 104, 106, 108 to be cut off forming pages 110, 112, 114, 116, 118, 120, 122 and 124. Web 66 is again folded about longitudinal line 125. Finally at station 126 the web 68 is cut transverse to its direction of movement to form individual units of equal width. Any conventional cutter may be used including the cutter illustrated having peripherally spaced, radially oriented cutting blades 127.

The completed devices 10, shown in FIG. 2, are collected at station 128.

While this invention has been described as having a preferred design, it will be understood that it is capable of further modification. This application, is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

I claim:

1. A display device for containers which have a neck, comprising:

(a) a plural sheet booklet having its pages joined along a common line and having front and back pages, (b) a separate flat relatively spring-like container engaging member glued to the back sheet adjacent the common line, (c) the container engaging member having a central cut-out opening with a periphery for engaging the neck of the container and oriented such that the neck can project upwardly through the cut-out section separating the back sheet and the container engaging member thereby pressing them apart, flexing the container engaging member and forcing the booklet against the bottle in an outwardly disposed position, and (d) the periphery of the central cut-out opening being shaped to provide a flexible locking member which engages the neck of the container.

2. The display device for containers as set forth in claim 1, wherein:

(a) the flexible locking section includes an inwardly extending tab.

3. A display device for containers which have a neck, comprising:

(a) a flat display piece having front and back sides, (b) a container engaging member made of a relatively strong flat resilient sheet of spring-like material which has a closed cut-out central opening through which the neck of the container can extend, (c) the container engaging member being adhesively attacked to the back side of the display piece and normally extending in a plane parallel and immediately adjacent thereto, (d) the container engaging member having an elongated separable container disengaging member integral with the container engaging member and which is cut out of the container engaging member thereby forming the closed cut out central opening.

4. The display device for containers as set forth in claim 3, wherein:

(a) the free end of the container disengaging member has an enlarged section which is readily graspable.

5. The display device for containers as set forth in claim 4, wherein:

(a) the overall shape of the container disengaging member is button-like with a supporting stem.

6. The display device for containers as set forth in claim 4, wherein:

(a) the shape of the container disengaging member is the same shape as the periphery of the central opening.

* * * * *